US010619476B2

(12) United States Patent
Hudson et al.

(10) Patent No.: US 10,619,476 B2
(45) Date of Patent: Apr. 14, 2020

(54) DOWNHOLE COMMUNICATION

(71) Applicant: Expro North Sea Limited, Reading, Berkshire (GB)

(72) Inventors: Steven Martin Hudson, Sturminster Newton (GB); Alexandra Vasil'evna Rogacheva, Southampton (GB)

(73) Assignee: Expro North Sea Limited, Dyce (GB)

( * ) Notice: Subject to any disclaimer, the term of this patent is extended or adjusted under 35 U.S.C. 154(b) by 383 days.

(21) Appl. No.: 14/429,692

(22) PCT Filed: Sep. 17, 2013

(86) PCT No.: PCT/GB2013/000384
§ 371 (c)(1),
(2) Date: Mar. 19, 2015

(87) PCT Pub. No.: WO2014/044995
PCT Pub. Date: Mar. 27, 2014

(65) Prior Publication Data

US 2015/0267530 A1 Sep. 24, 2015

(30) Foreign Application Priority Data

Sep. 19, 2012 (GB) ..... 1216762.3

(51) Int. Cl.
*E21B 47/12* (2012.01)

(52) U.S. Cl.
CPC ..... *E21B 47/122* (2013.01)

(58) Field of Classification Search
CPC ..... E21B 47/12; E21B 47/122
USPC ..... 166/381
See application file for complete search history.

(56) References Cited

U.S. PATENT DOCUMENTS

| | | | | |
|---|---|---|---|---|
| 5,914,911 | A * | 6/1999 | Babour | E21B 47/121 367/82 |
| 7,081,831 | B2 * | 7/2006 | Dodge | G01V 11/002 340/853.1 |
| 7,787,525 | B1 | 8/2010 | Clark et al. | |
| 2003/0192692 | A1 * | 10/2003 | Tubel | E21B 41/00 166/250.15 |
| 2008/0212691 | A1 | 9/2008 | Atherton | |
| 2008/0264633 | A1 | 10/2008 | Hudson | |
| 2008/0308271 | A1 * | 12/2008 | Chouzenoux | E21B 47/01 166/250.02 |
| 2011/0168446 | A1 | 7/2011 | Lemenager et al. | |

* cited by examiner

*Primary Examiner* — Nicole Coy
*Assistant Examiner* — Dany E Akakpo
(74) *Attorney, Agent, or Firm* — Getz Balich LLC

(57) ABSTRACT

A well installation communication system includes downhole metallic structure 2, a downhole communication unit 3, and a surface communication unit 4 arranged for electrical signal communication with the downhole communication unit via a signal channel. The signal channel includes a portion of the downhole metallic structure 2, a portion of cable 5 running within the downhole metallic structure away from said portion of the downhole metallic structure towards the surface and a connection device 6. The connection device 6 is in the signal channel between the portion of metallic structure 2 and the portion of cable 5. The connection device is removeably deployed in the metallic structure, is electrically disconnectably and reconnectably connected to the metallic structure and has a connector portion to which an end of the cable is mechanically and electrically connected.

24 Claims, 3 Drawing Sheets

DOWNHOLE COMMUNICATION

This application is entitled to the benefit of, and incorporates by reference essential subject matter disclosed in PCT Application No. PCT/GB2013/000384 filed on Sep. 17, 2013, which claims priority to Great Britain Application No. 1216762.3 filed Sep. 19, 2012.

BACKGROUND OF THE INVENTION

1. Technical Field

This invention relates to downhole communication and in particular to well installation communication systems for communication between a downhole unit and a surface unit where at least a part of the signal path between the downhole unit and surface unit travels along the downhole metallic structure.

2. Background Information

Presently there are a number of different signalling techniques used in oil and/or gas wells to communicate between devices provided downhole and the surface. This communication may be used, for example, for extracting data from downhole, such as data relating to pressure or temperature measurements. Likewise, the data may be transmitted to control downhole devices such as valves from the surface.

A number of different communication techniques are used for transmitting these signals. These include acoustic or mud pulsing systems used whilst drilling where pulses are used to transmit signals through the medium of the mud, wired systems where electrical signals are transmitted along cables, and wireless systems where electrical signals are transmitted without the use of dedicated cables. At least some wireless downhole communication systems make use of the metallic structure in the well as the signal path. Thus, typically electrical signals are applied to the downhole metallic structure and travel along this metallic structure towards the surface where they may be received by a surface unit.

Whilst such systems can function effectively, there can be limits on range and achievable data rates due to the non ideal nature of the metallic structure as a signal channel.

SUMMARY OF THE INVENTION

The present invention is aimed at addressing at least one of these issues.

According to a first aspect of the present invention there is provided a well installation communication system comprising downhole metallic structure, a downhole communication unit, and a surface communication unit arranged for electrical signal communication with the downhole communication unit via a signal channel, the signal channel comprising: a portion of the downhole metallic structure, a portion of cable running within the downhole metallic structure away from said portion of the downhole metallic structure towards the surface and a connection device, the connection device being in the signal channel between the portion of metallic structure and the portion of cable, the connection device being removeably deployed in the metallic structure, being electrically disconnectably and reconnectably connected to the metallic structure and having a connector portion to which an end of the cable is mechanically and electrically connected.

This arrangement allows better signal characteristics to be obtained than a situation where a signal travels all of the way between the communication units along the metallic structure. Further the cable and connection device can be introduced into the well and connected to the metallic structure when it is desired to signal but removed when signalling is not required. This reduces disturbance in the well and minimises the time for which any additional leakage risk is suffered.

The connection device provides electrical signalling connection between the cable and the portion of downhole metallic structure. The connection device may provide mechanical connection between the cable and the portion of downhole metallic structure, typically however, there will be mechanical contact as opposed to mechanical connection.

The connection device may be connected electrically in series between the portion of metallic structure and the portion of cable.

The connection device may provide a dc electrical connection between the cable and the portion of downhole metallic structure or they may be a more indirect connection allowing signalling.

The connection device may provide inductive coupling between the cable and the portion of downhole metallic structure.

A complementary connector portion may be provided at the end of the cable for connecting with the connector portion of the connection device.

The connector portion and complementary connector portion may be arranged to provide mechanical and electrical connection between the cable and connection device.

The cable may comprise a pair of conductors running in parallel, for example, the cable may be a coaxial cable with a core conductor and a surrounding shield conductor. The connection device may be arranged to electrically connect the core conductor to the portion of metallic structure. The connection device may be arranged to electrically connect the surrounding shield conductor to the portion of metallic structure.

The cable may comprise an eline.

Typically the downhole metallic structure comprises pipe such as casing, lining, drill string tubing, or production tubing.

Preferably the downhole metallic structure comprises production tubing. Preferably the portion of the downhole metallic structure is a portion of production tubing.

The connection device may be arranged for contacting with an internal surface of the portion of the downhole metallic structure. The connection device may be arranged for contacting with the internal surface of pipe.

The connection device may comprise a body portion and provided on the body portion at least one contact portion for contacting with the portion of the downhole metallic structure. The connector portion may be provided on the body portion.

There may be a plurality of contact portions. An axially spaced pair of contact portions may be provided on the body portion. A first of the contact portions in the pair may be electrically connected to one of the conductors in the cable, for example, the core conductor and a second of the contact portions in the pair may be electrically connected to another of the conductors in the cable, for example, the surrounding shield conductor.

The connection device may comprise a transformer arrangement which may have a first winding connected between first and second conductors in the cable, for example, the core conductor and shield conductor of the cable, and a second winding connected between the spaced pair of contact portions so that varying signals flowing in the cable will cause current changes in the first winding, inducing current in the second winding and hence the portion of metallic structure and vice versa.

The connection device may comprise a conductive centraliser. The connection device may comprise a bow spring centraliser. The connection device may comprise a spaced pair of conductive centralisers. Each may comprise a bow spring centraliser.

The or each contact portion may comprise a respective conductive centraliser.

According to another aspect of the present invention there is provided a method of electrical signal communication using a well installation communication system according to the first aspect of the invention comprising the steps of: i) applying electrical signals to the downhole metallic structure using the downhole communication unit so as to cause electrical signals to propagate through the portion of metallic structure and the portion of cable via the connection device and picking up the electrical signals from the cable using the surface communication unit; or ii) applying electrical signals to the cable using the surface communication unit so as to cause electrical signals to propagate through the portion of cable and the portion of metallic structure via the connection device and picking up the electrical signals from the downhole metallic structure using the downhole communication unit.

According to another aspect of the present invention there is provided a method of electrical signal communication in a well installation comprising downhole metallic structure and a downhole communication unit arranged for transmitting and/or receiving signals via the downhole metallic structure, comprising the steps of: introducing a connection device carried by a portion of cable into the well from the surface so as to run the cable within the downhole metallic structure and position the connection device in the downhole metallic structure at a downhole location and electrically connect the connection device to a portion of the downhole metallic structure, the connection device having a connector portion to which an end of the cable is mechanically and electrically connected; electrically connecting another end of the portion of cable to a surface communication unit; and signalling between the downhole communication unit and surface communication unit via the resulting signal channel comprising the portion of the downhole metallic structure, the portion of cable running within the downhole metallic structure away from said portion of the downhole metallic structure towards the surface and connected in the signal channel between the portion metallic structure and the portion of cable, the connection device.

According to another aspect of the present invention there is provided apparatus for use in a well installation communication system of the first aspect of the invention, comprising: a portion of cable; a downhole communication unit and a surface communication unit arranged for electrical signal communication with the downhole communication unit via a signal channel including a portion of downhole metallic structure and the portion of cable; a connection device for connection in between the portion of metallic structure and the portion of cable, the connection device being electrically connectable to the metallic structure and having a connector portion to which an end of the cable is mechanically and electrically connectable.

According to another aspect of the present invention there is provided a well installation comprising a well installation communication system as defined above.

The optional and preferred features mentioned following the first aspect of the invention are not all repeated after each of the other aspects of the invention in the interests of brevity. However it should be appreciated that these features are, with any necessary changes in wording, also optional and preferred features of the other aspects of the invention defined above.

BRIEF DESCRIPTION OF THE DRAWINGS

Embodiments of the present invention will now be described, by way of example only, with reference to the accompanying drawings, in which.

DETAILED DESCRIPTION

Figure 1:
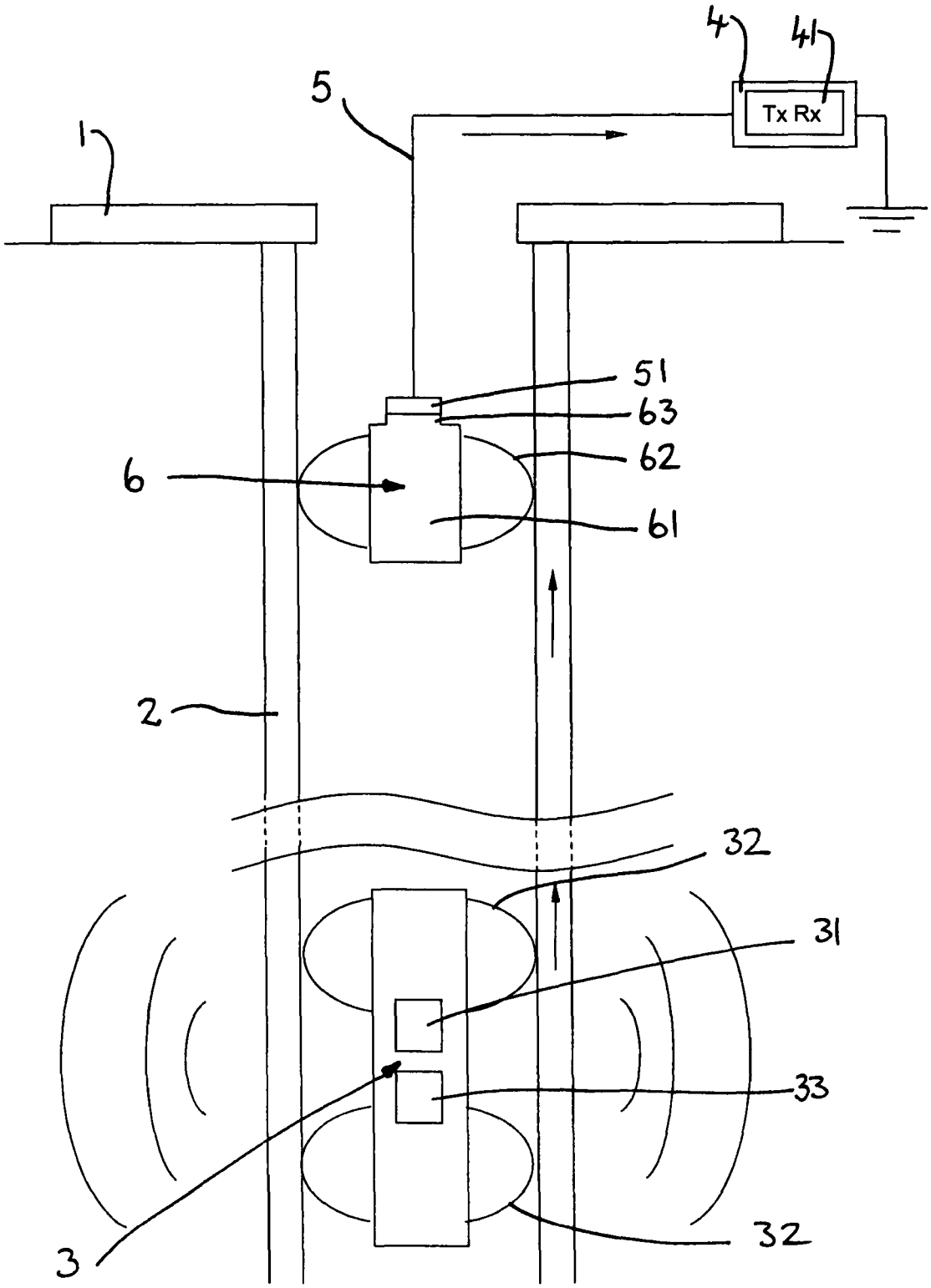
FIG. 1 is a schematic view of a well installation including a well installation communication system.

FIG. 1 shows an oil and/or gas well installation comprising a well head 1 and leading away from the well head and downhole into the well, downhole metallic structure 2. In the present embodiment the downhole metallic structure 2 is production tubing but in other cases this may be other downhole pipe material such as casing, lining or drill string tubing.

Located downhole in the well is a tool 3 and provided at the surface is a surface unit 4. The tool 3 in the present embodiment is arranged for taking measurements of downhole parameters, such as pressure and temperature, and further arranged for communicating with the surface unit 4. As such, the downhole tool 3 is a downhole communication unit and the surface unit 4 is a surface communications unit. The downhole tool 3 comprises a transceiver 31 arranged for applying signals to the metallic structure 2 and receiving signals therefrom via spaced conductors 32. The downhole tool 3 also comprises other components 33 such as sensors and associated electronics for taking the desired parameter measurements.

Note that in the present embodiment, the downhole tool 3 is arranged as an electrical dipole tool for applying an electrical signal to the metallic structure 2 which will propagate away from the tool 3 towards the surface. An example of such an electric dipole 2 is a "CaTs" tool commercially available from the applicants. However other forms of downhole device for signalling and/or picking up signals from the downhole metallic structure may be used in the present techniques. Thus, for example, a system may be used where downhole signals are transmitted across and picked up across an isolation (or insulation) joint provided in the metallic structure 2. Further the downhole tool 3 may be disposed in an open hole location and signal from there. That is the tool 3 may be located further down in the well than the metallic structure 2 extends. In such a case signals will still travel into and along the metallic structure for transmission towards the surface once the metallic structure is reached.

The surface unit 4 includes a transceiver unit 41 for receiving signals from the downhole tool 3 and sending signals to the downhole tool 3. Thus in the present embodiment there can be two way communication between the downhole tool 3 and surface unit 4. However in other embodiments there may be communication in only one direction. Thus, for example, the surface unit might be used to send control signals to a downhole tool 3 or there may be simply data sent back from the downhole tool 3 to the surface 4 without a facility for sending signals downhole back to the tool 3.

In a conventional wireless signalling arrangement where the metallic structure 2 downhole is used as a signal channel, the respective surface unit 4 would normally be connected to the well head 1 or to pipe/structure on the surface side of the well head 1 in order to pick up signals. In the present system and method however, a cable 5 and connection device 6 are introduced into the signal channel. Thus signals between the downhole tool 3 and surface unit 4 travel along the metallic structure 2 through the connection device 6 and then into the cable 5 and from the cable 5 to the surface unit 4.

In the present embodiment, the cable 5 comprises an e-line. E-lines are known in the oil and gas industry and are arranged both for use in deployment of components downhole and also to provide power and/or signals to the components which are deployed. The e-line 5 in conventional systems and in the present system is provided on a reel (not shown) at the surface in usual circumstances to allow the cable 5 to be fed out as a component (in this case the connection device 6) is deployed into the well.

The e-line is used in a non-conventional way in the present techniques as will be explained in more detail below.

The connection device 6 comprises a body portion 61 on which are provided a contact portion 62 and a connector portion 63. The cable 5 supports the connection device 6 in the well.

The contact portion 62 comprises a conductive centraliser and specifically a bow spring centraliser. Thus the contact portion 62 has a plurality of contacts each arranged as a bow spring and of an electrically conductive material as is the body portion 61. Furthermore the contact portion 62 is arranged for making electrical contact with surfaces against which it is pressed. Thus in the present case the contact portion 62 makes electrical contact with the internal surface of the downhole metallic structure, in particular the production tubing 2, in which it is located. Provided at the end of the cable 5 is a complimentary connector portion 51 which is arranged for mechanically and electrically connecting to the connector portion 63 of the connection device 6. Furthermore the connection portion 61 is arranged for ensuring direct electrical connection of the current carrying conductor or conductors of the cable 5 to the connection device 6 and specifically the contact portion 62. In the present embodiment the cable 5 is a coaxial cable and the complimentary connector portion 51 will be arranged for directly electrically connecting the core of the cable 5 to the connection device 6 and hence contact portion 62. Thus the core of the cable 5 (which can provide a high quality signal path) is connected via the connection device 6 to the metallic structure 2. This means that, in use, the signal path from the downhole tool 3 to the surface unit 4 is via a portion of the downhole structure 2 between the tool 3 and the connection device 6 and then via the connection device 6 to the cable 5 and onto the surface unit 4.

In effect the core of the eline cable 5 is connected to local earth by the connection device 6. At first sight this seems a nonsense, but as part of the present communication techniques it yields significant benefit.

In the present embodiment the cable 5 is connected directly to the surface unit 4. However this need not necessarily be the case. Furthermore there may be some break in the downhole metallic structure between the connection device 6 and the downhole tool 3, but provided that this is bridged in some way or another so that there is a complete signal path, this need be of no great significance.

The connection device 6 and cable 5 are arranged for deployment in the well when it is desired to signal and removal at other times. When the connection device 6 is in situ, the conductor (inner core in this case) of the cable 5 provides a high quality signal path to improve signalling but at the same time a permanent presence of a cable in the well is avoided. The cable 5 and connection device 6 may be retracted from the well when not required and reintroduced as and when desired.

The fact that the cable 5 and connection device 6 may be retracted out of the well when it is not desired to take pressure and or temperature readings reduces interference in the well and reduces any associated increased risk of leakage due to the cable 5 passing through the well head.

The connection device 6 will typically be deployed to the maximum practical depth in the well in order to improve signal transmission since the losses along the cable 5 will be much lower than those through the metallic structure 2. Thus, for example, the connection device 6 may be positioned just above a packer provided in a well, or just above a lateral (for example where signals need to be picked up from the main bore and the lateral), or at a maximum depth to which the e-line can extend.

Figure 2:
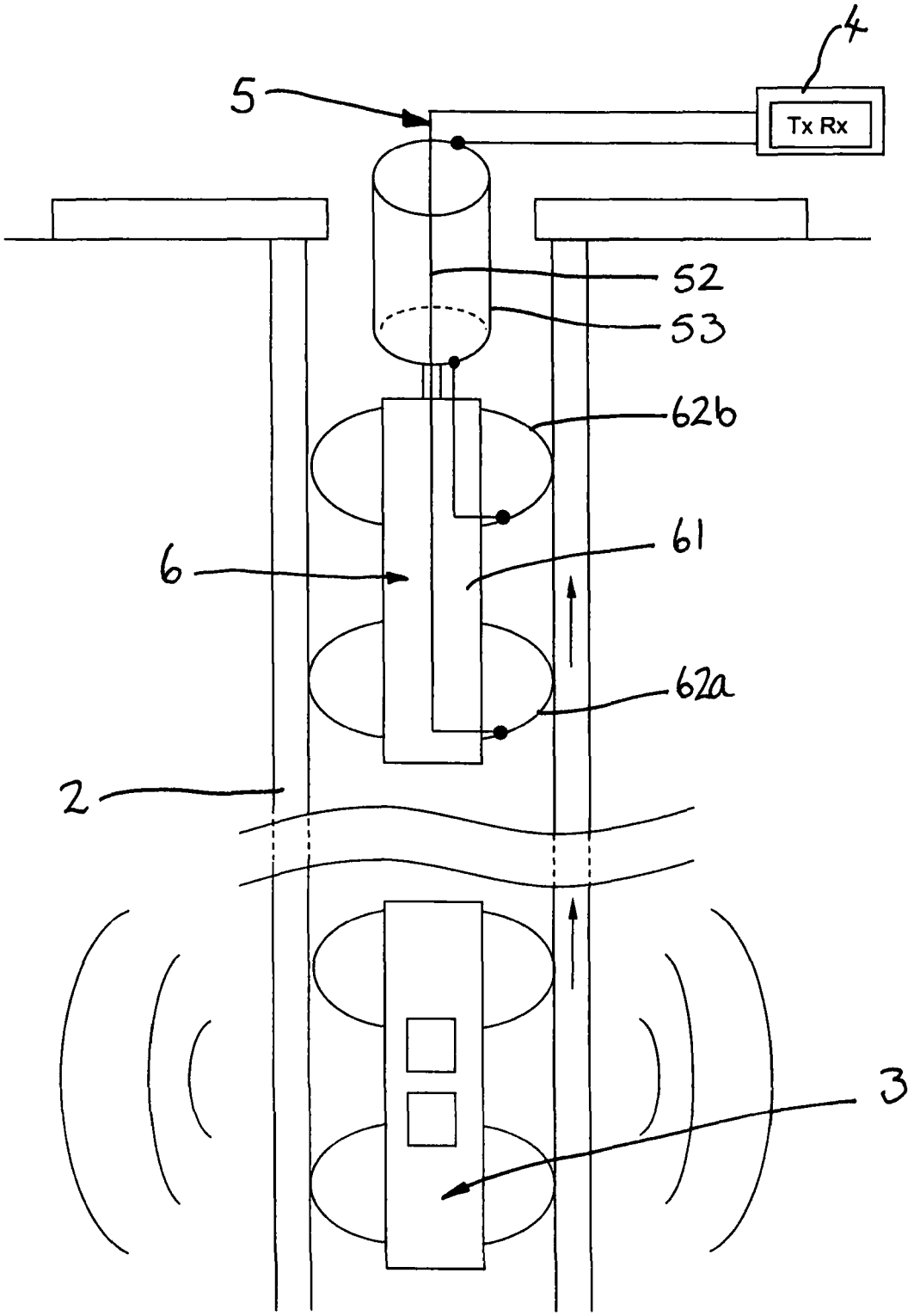
FIG. 2 is a schematic view of a well installation including an alternative well installation communication system.

FIG. 2 schematically shows an oil and/or gas well installation which is similar to that shown and described above with respect to FIG. 1 but which includes an alternative well installation communication system.

The same reference numerals are used to indicate the parts of the installation shown in FIG. 2 which are in common with those shown in FIG. 1 and detailed description of these parts is omitted for the sake of brevity.

Again there is a downhole tool 3 located in downhole metallic structure 2 which is arranged for communication with a surface unit 4. Further a connection device 6 and cable 5 are introduced into the signal channel such that the signal channel between the downhole tool 3 and surface unit 4 includes the metallic structure 2, the connection device 6 and the cable 5 in sequence. However in this embodiment the connection device 6 has a different structure as will be described in more detail below.

A body portion 61 of the connection device 6 has provided thereon two axially spaced contact portions 62*a* and 62*b* each of which is provided in the form of a bow spring centraliser.

Thus the connection device 6 of the present embodiment provides two spaced contact points with the metallic structure 2 in the region of the connection device 6. The cable 5 in this embodiment is again provided for supporting the connection device 6 (allowing its deployment and retraction) and for carrying signals. In the present embodiment the cable 5 is a coaxial cable with its central conductive core 52 connected to a first of the bow spring centralisers 62*a* and its conductive outer shielding 53 connected to the other of the bow spring centralisers 62*b*. Both the conductive core 52 and conductive surrounding shield 53 are connected to the surface unit 4 and thus the surface unit 4 is able to pick up signals from the metallic structure 2 by detecting a potential difference in the metallic structure 2 between the two contact points provided by the first and second bow spring centralisers 62*a* and 62*b*. This is in contrast to the embodiment of FIG. 1 where the signals in the metallic structure are detected relative to a reference earth.

Thus the embodiment of FIG. 2 provides a different connection technique for picking up signals out of the metallic structure 2 using the connection device 6 but otherwise the structure, operation and use of the system can be the same as that in the embodiment of FIG. 1.

Figure 3:
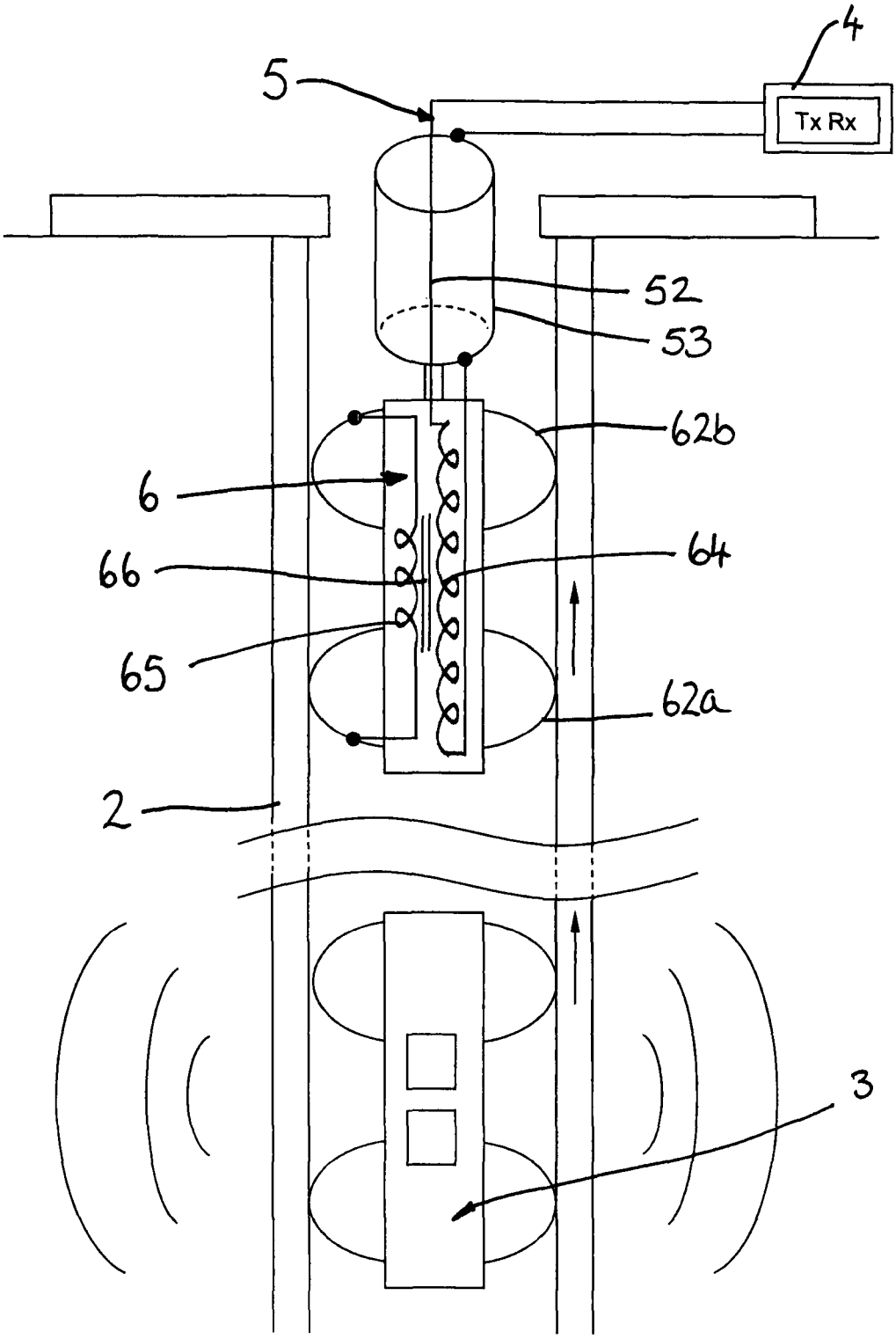
FIG. 3 is a schematic view of a well installation including another alternative well installation communication system.

FIG. 3 shows a well installation including another alternative well installation communications system. Again in this case the main differences lie in the arrangement of the connection device 6 and its connection to the cable 5.

Again the same reference numerals are used in respect of the features which are in common between this embodiment and those of FIGS. 1 and 2. Detailed description of those common elements is omitted for the sake of brevity.

Again there is a downhole tool 3 arranged for communication with a surface unit 4 via a signal channel which includes metallic structure in the well 2, a connection device 6 and a cable 5.

As in the system of FIG. 2, the connection device 6 in this embodiment includes two axially spaced connection portions, each comprising a respective bow spring centraliser 62*a* and 62*b*. Again the cable 5 is a coaxial cable with both the conductive core 52 and conductive shielding 53 being used in signalling and being connected to the surface unit 4.

However in this instance the connection device 6 makes use of inductive coupling for transferring signals between the cable 5 and the metallic structure 2. The conductive centralisers 62*a* and 62*b* still make direct electrical contact with the metallic structure but the body 61 of the connection device 6 houses a transformer arrangement. A first coil or winding 64 is connected at one end to the conductive core 52 of the cable 5 and at the other end to the conductive shielding 53 of the cable 5. A second coil or winding 53 has a first end connected to a first of the conductor centralisers 62*a* and a second end connected to a second of the conductive centralisers 62*b*. A suitable core 66 is provided for these two windings 64, 65. The windings 64, 65 and core 66 are arranged as a transformer so that there is inductive coupling between the windings and hence between the cable 5 and the metallic structure 2. Thus signals may be transferred between the cable 5 and metallic structure 2 via the transformer arrangement. Further the number of turns on the windings 64, 65 may be chosen in order to optimise signal transfer between the metallic structure 2 and the cable 5. Typically there will be more turns on the winding 64 connected to the cable 5 than the winding 65 connected to the conductive centralisers 62*a*, 62*b*.

Again, the communication system of FIG. 3 can have the same general structure, operation and uses as that of FIGS. 1 and 2. The different detailed structure of the connection device 6 may provide better signalling characteristics in at least some circumstances.

In alternative forms of any of the above embodiments, and in particular that of FIG. 2, the connection device 6 may comprise a pre-amplifier to amplify the signal which is to be carried by the cable 5. This can help reduce the effect of surface noise and is particularly useful where the shielding 53 of the cable 5 is used in carrying the signal. Thus a pre-amplifier may, for example in a modified version of the FIG. 2 embodiment, be provided between the core 52 and one of the spaced contact portions 62*a* and/or between the shielding 53 and the other of the spaced contact portions 62*b*.

The present technique might most typically be used in producing wells, dormant/temporarily shut down wells, or abandoned wells.

What is claimed is:

1. A well installation communication system comprising:

a downhole metallic structure;

a downhole communication unit deployed at at least one of:

a location within the downhole metallic structure, or an open hole location beyond where the downhole metallic structure extends;

wherein the downhole communication unit is configured to communicate electrical signals from the location within the downhole metallic structure, or from the open hole location, into and along the downhole metallic structure to a surface communication unit arranged for electrical signal communication with the downhole communication unit, such that the electrical signals communicated into and along the downhole metallic structure are configured for receipt at that surface communication unit using the downhole metallic structure as a first signal channel;

the well installation communication system further comprising a cable and a connection device being entirely uphole of the downhole communication unit and being removeably deployable in the downhole metallic structure, the connection device being electrically disconnectably and reconnectably connectable to the downhole metallic structure, and having a connector portion to which an end of the cable is mechanically and electrically connected, the cable and connection device configured such that, when deployed and electrically connected in the downhole metallic structure, a second signal channel is formed comprising:

a portion of the downhole metallic structure; and a portion of the cable running within the downhole metallic structure away from said portion of the downhole metallic structure towards the surface, the second signal channel providing better signal characteristics at the surface communication unit than when signals would otherwise travel all the way between the downhole communication unit and the surface communication unit along the downhole metallic structure;

wherein the downhole communication unit is not integrated into the downhole metallic structure.

2. A well installation communication system according to claim 1 in which the connection device provides mechanical contact between the cable and the portion of downhole metallic structure.

3. A well installation communication system according to claim 1 in which a complementary connector portion is provided at the end of the cable for connecting with the connector portion of the connection device.

4. A well installation communication system according to claim 3 in which the connector portion and complementary connector portion are arranged to provide mechanical and electrical connection between the cable and connection device.

5. A well installation communication system according to claim 1 in which the cable is a coaxial cable with a core conductor and a surrounding shield conductor and the connection device is arranged to electrically connect the core conductor to the portion of metallic structure.

6. A well installation communication system according to claim 5, in which the connection device is arranged to electrically connect the surrounding shield conductor to the portion of the metallic structure.

7. A well installation communication system according to claim 5, wherein the core conductor is connected to local earth by the connection device.

8. A well installation communication system according to claim 1 in which the cable comprises an eline.

9. A well installation communication system according to claim 1 in which the connection device is arranged for contacting with the internal surface of pipe.

10. A well installation communication system according to claim 1 in which the connection device comprises a body portion and provided on the body portion at least one contact portion for contacting with the portion of the downhole metallic structure.

11. A well installation communication system according to claim 1 in which the connection device comprises an axially spaced pair of contact portions provided on the body portion.

12. A well installation communication system according to claim 11 where the cable comprises a pair of conductors and a first contact portion in the pair is electrically connected to a first of the conductors, and a second contact portion in the pair is electrically connected to a second of the conductors.

13. A well installation communication system according to claim 11 in which the cable comprises a pair of conductors and the connection device comprises a transformer wherein a first winding is connected between a first of the pair of conductors and a second of the pair of conductors of the cable and second winding is connected between the spaced pair of contact portions.

14. A well installation communication system according to claim 1 in which the connection device comprises a conductive centraliser.

15. A well installation communication system according to claim 14 in which the connection device comprises a bow spring centraliser.

16. A method of electrical signal communication using a well installation communication system, comprising the steps of:

providing a well installation communication system that includes:

a downhole metallic structure;

a downhole communication unit deployed at at least one of:

a location within the downhole metallic structure; or an open hole location beyond where the downhole metallic structure extends;

wherein the downhole communication unit is configured to communicate electrical signals from the location within the downhole metallic structure, or from the open hole location, into and along the downhole metallic structure to a surface communication unit arranged for electrical signal communication with the downhole communication unit, such that the electrical signals communicated into and along the downhole metallic structure are configured for receipt at that surface communication unit using the downhole metallic structure as a first signal channel, and wherein the downhole communication unit is not integrated into the downhole metallic structure;

the well installation communication system further comprising a cable and a connection device being removeably deployable in the downhole metallic structure, the connection device being entirely uphole of the downhole communication unit and being electrically disconnectably and reconnectably connectable to the downhole metallic structure, and having a connector portion to which an end of the cable is mechanically and electrically connected, the cable and connection device configured such that, when deployed and electrically connected in the downhole metallic structure, a second signal channel is formed comprising:

a portion of the downhole metallic structure, and a portion of the cable running within the downhole metallic structure away from said portion of the downhole metallic structure towards the surface, the second signal channel providing better signal characteristics at the surface communication unit than when signals would otherwise travel all the way between the downhole communication unit and the surface communication unit along the downhole metallic structure; and applying first electrical signals to the downhole metallic structure using the downhole communication unit so as to cause the first electrical signals to propagate through the portion of metallic structure and the portion of cable via the connection device and picking up the first electrical signals from the cable using the surface communication unit; or applying second electrical signals to the cable using the surface communication unit so as to cause the second electrical signals to propagate through the portion of cable and the portion of metallic structure via the connection device and picking up the second electrical signals having been communicated by the downhole metallic structure using the downhole communication unit.

17. A method of electrical signal communication in a well installation comprising a downhole metallic structure and a downhole communication unit, deployed at at least one of:

a location within the downhole metallic structure; or an open hole location beyond where the downhole metallic structure extends;

wherein the downhole communication unit is configured to communicate electrical signals from the location within the downhole metallic structure, or from the open hole location, into and along the downhole metallic structure towards a surface communication unit arranged for electrical signal communication with the downhole communication unit, such that the electrical signals communicated into and along the downhole metallic structure are configured for receipt at that surface communication unit using the downhole metallic structure as a signal channel, and wherein the downhole communication unit is not integrated into the downhole metallic structure;

the downhole communication unit being arranged for transmitting and/or receiving signals via the downhole metallic structure, the method further comprising the steps of:

introducing a connection device carried by a portion of cable into the well from the surface so as to run the cable within the downhole metallic structure and position the connection device in the downhole metallic structure at a downhole location entirely uphole of the downhole communication unit and electrically connect the connection device to a portion of the downhole metallic structure, the connection device having a connector portion to which an end of the cable is mechanically and electrically connected, the cable and connection device configured such that, when deployed and electrically connected in the downhole metallic structure, an alternative signal channel is formed comprising the portion of the downhole metallic structure and the portion of the cable running within the downhole metallic structure away from said portion of the downhole metallic structure towards the surface; and electrically connecting another end of the portion of the cable to the surface communication unit to permit signalling between the downhole communication unit and surface communication unit via the resulting alternative signal channel, that alternative signal channel providing better signal characteristics at the surface communication unit than when signals would otherwise travel all the way between the downhole communication unit and the surface communication unit along the downhole metallic structure.

18. Apparatus for use in a well installation communication system, comprising:

a portion of cable;

a surface communication unit arranged for electrical signal communication with a downhole communication unit deployed at at least one of:

a location within a downhole metallic structure, or an open hole location beyond where the downhole metallic structure extends, wherein the downhole communication unit is configured to not be integrated into the downhole metallic structure and configured to communicate electrical signals from the location within the downhole metallic structure, or from the open hole location, into and along the downhole metallic structure to the surface communication unit, such that electrical signals communicated into and along the downhole metallic structure are configured for receipt at that surface communication unit using the downhole metallic structure as a signal channel; and a connection device for connection in between a portion of metallic structure and the portion of cable, the connection device being entirely uphole of the downhole communication unit and being electrically connectable to the downhole metallic structure and having a connector portion to which an end of the cable is mechanically and electrically connectable, the cable and connection device configured such that, when deployed and electrically connected in the downhole metallic structure, an alternative signal channel is formed comprising the portion of the downhole metallic structure and the portion of the cable running within the downhole metallic structure away from said portion of the downhole metallic structure towards the surface, that alternative signal channel providing better signal characteristics at the surface communication unit than when signals would otherwise travel all the way between the downhole communication unit and the surface communication unit along the downhole metallic structure.

19. The apparatus of claim 18 wherein the apparatus further comprises the downhole communication unit.

20. The apparatus of claim 19, wherein the downhole communication unit has been deployed in an open hole location beyond where the downhole metallic structure extends.

21. The apparatus of claim 19, wherein the downhole communication unit has been deployed at a location within the downhole metallic structure.

22. A well installation communication system, comprising:

a downhole metallic structure;

a downhole communication unit deployed at at least one of:

a location within the downhole metallic structure, or an open hole location beyond where the downhole metallic structure extends;

wherein the downhole communication unit is configured to communicate electrical signals from the location within the downhole metallic structure, or from the open hole location, into and along the downhole metallic structure to a surface communication unit arranged for electrical signal communication with the downhole communication unit, such that the electrical signals communicated into and along the downhole metallic structure are configured for receipt at that surface communication unit using the downhole metallic structure as a first signal channel;

wherein the downhole communication unit is arranged as an electric dipole tool for applying said electrical signal to the downhole metallic structure which will propagate away from the downhole communication unit towards surface;

the well installation communication system further comprising a cable and a connection device being entirely uphole of the downhole communication unit and being removeably deployable in the downhole metallic structure, the connection device being electrically disconnectably and reconnectably connectable to the downhole metallic structure, and having a connector portion to which an end of the cable is mechanically and electrically connected, the cable and connection device configured such that, when deployed and electrically connected in the downhole metallic structure a second signal channel is formed comprising:

a portion of the downhole metallic structure; and a portion of the cable running within the downhole metallic structure away from said portion of the downhole metallic structure towards the surface, the second signal channel providing better signal characteristics at the surface communication unit than when signals would otherwise travel all the way between the downhole communication unit and the surface communication unit along the downhole metallic structure.

23. A well installation communication system according to claim 22, wherein the downhole communication unit is positioned downhole of the connection device.

24. Apparatus for use in a well installation communication system, comprising:

a portion of cable;

a surface communication unit arranged for electrical signal communication with a downhole communication unit configured to be deployed in an open hole location beyond where the downhole metallic structure extends, wherein the downhole communication unit is configured to communicate electrical signals from the location within the downhole metallic structure, or from the open hole location, into and along the downhole metallic structure to the surface communication unit, such that the electrical signals communicated into and along the downhole metallic structure are configured for receipt at the surface communication unit using the downhole metallic structure as a signal channel;

a connection device for connection in between a portion of the downhole metallic structure and the portion of cable, the connection device being entirely uphole of the downhole communication unit and being electrically connectable to the downhole metallic structure and having a connector portion to which an end of the cable is mechanically and electrically connectable, the cable and connection device configured such that, when deployed and electrically connected in the downhole metallic structure, an alternative signal channel is formed comprising the portion of the downhole metallic structure and the portion of the cable running within the downhole metallic structure away from said portion of the downhole metallic structure towards the surface, that alternative signal channel providing better signal characteristics at the surface communication unit than when signals would otherwise travel all the way between the downhole communication unit and the surface communication unit along the downhole metallic structure.

* * * * *